US006851141B2

(12) United States Patent
McMahan

(10) Patent No.: US 6,851,141 B2
(45) Date of Patent: Feb. 8, 2005

(54) ANTI-FATIGUE MAT

(76) Inventor: Robert L. McMahan, 1606 Buttercup Creek Blvd., Cedar Park, TX (US) 78613

( * ) Notice: Subject to any disclaimer, the term of this patent is extended or adjusted under 35 U.S.C. 154(b) by 0 days.

(21) Appl. No.: 10/447,048

(22) Filed: May 28, 2003

(65) Prior Publication Data

US 2004/0237194 A1 Dec. 2, 2004

(51) Int. Cl.[7] ..... A47G 9/06; B32B 3/06

(52) U.S. Cl. ..... 5/420; 5/417; 428/71; 428/76; 428/102; 428/193; 428/194

(58) Field of Search ..... 5/417–420; 428/68, 428/71, 76, 102, 192–194

(56) References Cited

U.S. PATENT DOCUMENTS 3,259,925 A * 7/1966 Tilles ..... 5/655.9
3,634,895 A * 1/1972 Childers ..... 5/420
4,450,193 A * 5/1984 Staebler ..... 428/71
4,574,101 A * 3/1986 Tricca et al. ..... 428/138
5,645,914 A * 7/1997 Horowitz ..... 428/81
6,324,710 B1 * 12/2001 Hernandez et al. ..... 5/630
6,568,005 B2 * 5/2003 Fleming et al. ..... 5/420
6,651,277 B1 * 11/2003 Marson ..... 5/420

OTHER PUBLICATIONS

Premo–Promos "Cyber Gel Mouse Pad"—Premo–Promos, LLC—(c) 2003.
Epinions—Revised—Fellowes gel rest & mouse pad–feels great—May 25, 2000 (updated Nov. 8, 2000).
Branders.com—Fun Mousepads (c) 2002.
Good Raise Chemical—Soft Mat (c) 1999–2004.
Lazy J Quarterhorses—Tenderfoot Stall Mats (c) 2002.

* cited by examiner

*Primary Examiner*—Teri Pham Luu
(74) *Attorney, Agent, or Firm*—Mark P. Kahler

(57) ABSTRACT

A resilient mat is disclosed which provides cushioning and comfort to users standing thereon or otherwise contacting the mat. The mat includes a resilient gel inner layer surrounded by a support ring to which an upper cover member and a lower cover member are attached. The support ring exhibits stiffness greater than the stiffness of the upper and lower cover members so that adherence of the upper and lower cover members to the support ring is enhanced even after prolonged use. The upper and lower cover members can exhibit the same or different colors in particular embodiments. The upper and lower cover members also can exhibit anti-slip properties in selected embodiments.

25 Claims, 4 Drawing Sheets

ANTI-FATIGUE MAT

BACKGROUND

The disclosures herein relate generally to mats and more particularly to resilient floor mats for reducing user fatigue.

Floor mats have been used for years to provide a cushion for the person standing on the mat. However, fatigue can still result when a person stands on a mat for an extended period of time. Persons who work standing up most of the day, such as cashiers, assembly line operators, people in home or commercial kitchens and many others still experience fatigue after standing on a conventional mat for long periods of time. Often floor mats are provided with non-slip surfaces to lessen slippage and to thus promote safety.

Mats of resilient foam are known to reduce user fatigue. Unfortunately however, foam mats have the disadvantage of becoming brittle over time. Conventional foam mats lose their properties as air cells in the mat compress. Also, conventional foam mats collect moisture over time. This condition can promote the growth of bacteria and fungus. These undesirable characteristics result in foam mats becoming unsuitable for use as they become older.

What is needed is a mat which reduces fatigue of users in both the commercial and consumer environment without exhibiting the undesirable properties discussed above.

SUMMARY

Accordingly, in one embodiment, an anti-fatigue mat is provided which includes a resilient gel layer exhibiting first and second major opposed surfaces and a peripheral edge. The mat also includes a first flexible cover member situated on the first major opposed surface of the resilient gel layer. The mat further includes a second flexible cover member situated on the second major opposed surface of the resilient gel layer. The second flexible cover member is attached to the first flexible cover member adjacent the peripheral edge. The second flexible cover member includes an external surface which exhibits anti-slip properties.

Another embodiment of the disclosed mat includes a resilient gel layer exhibiting first and second major opposed surfaces and a peripheral edge. The mat also includes a first flexible cover member situated on the first major opposed surface of the resilient gel layer. The first flexible cover member includes a first perimeter region. The mat further includes a second flexible cover member situated on the second major opposed surface of the resilient gel layer. The second flexible cover member includes a second perimeter region. The mat still further includes a support ring situated between the first and second perimeter regions adjacent the peripheral edge of the resilient gel layer to enhance adherence of the first and second flexible cover members together around the resilient gel layer thus enclosed.

A principal advantage of the embodiment disclosed herein is that user fatigue is significantly reduced.

DETAILED DESCRIPTION

Figure 1:
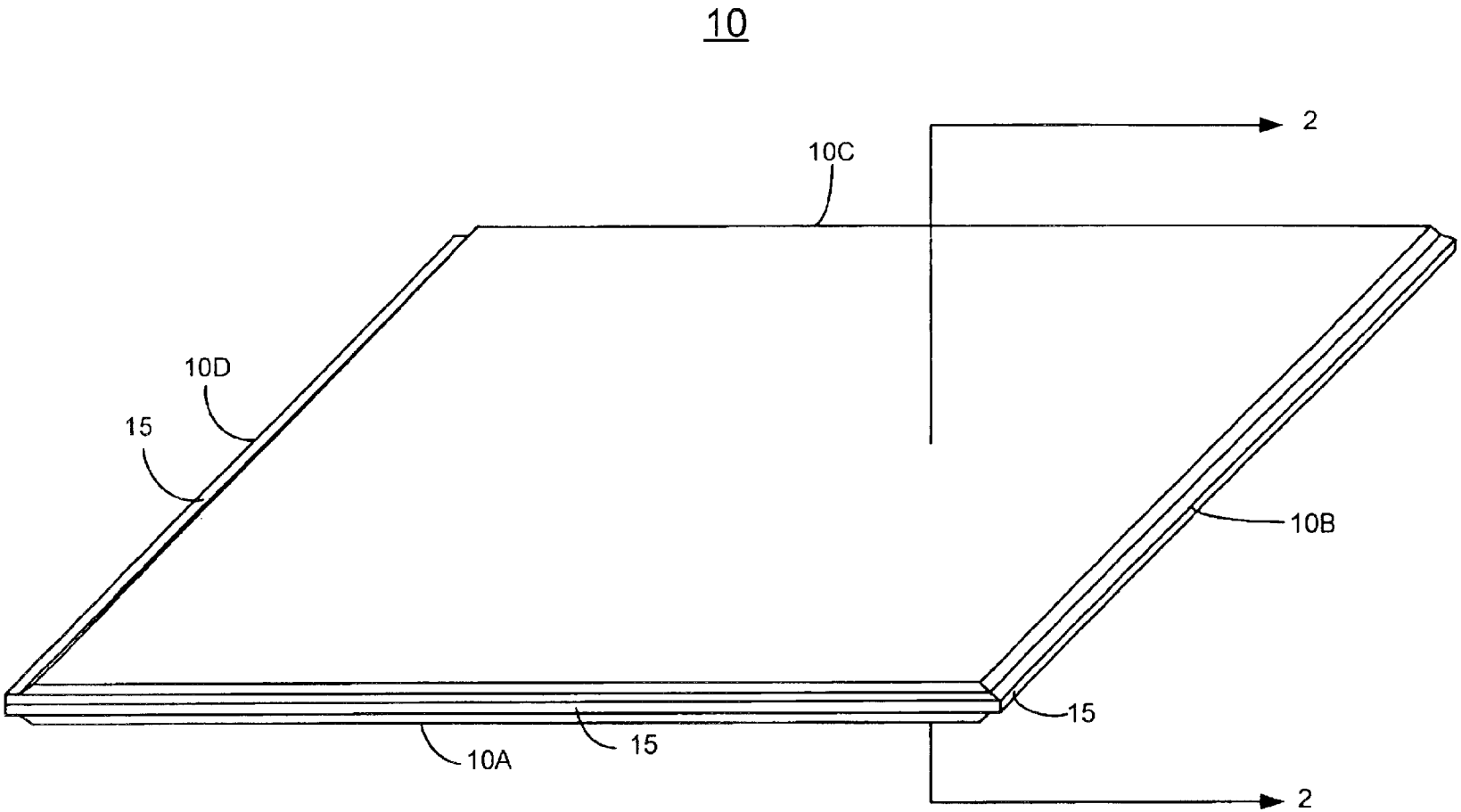
FIG. 1 is a top perspective view of the disclosed anti-fatigue mat.

FIG. 1 shows one embodiment of the disclosed anti-fatigue mat as mat 10. Mat 10 includes an edge surface 15 which extends around the perimeter formed by sides 10A, 10B, 10C and 10D. In this particular implementation, mat 10 is rectangular. However, the disclosed mat can readily be adapted to other geometries such as square, circular and elliptical, for example.

Figure 2:
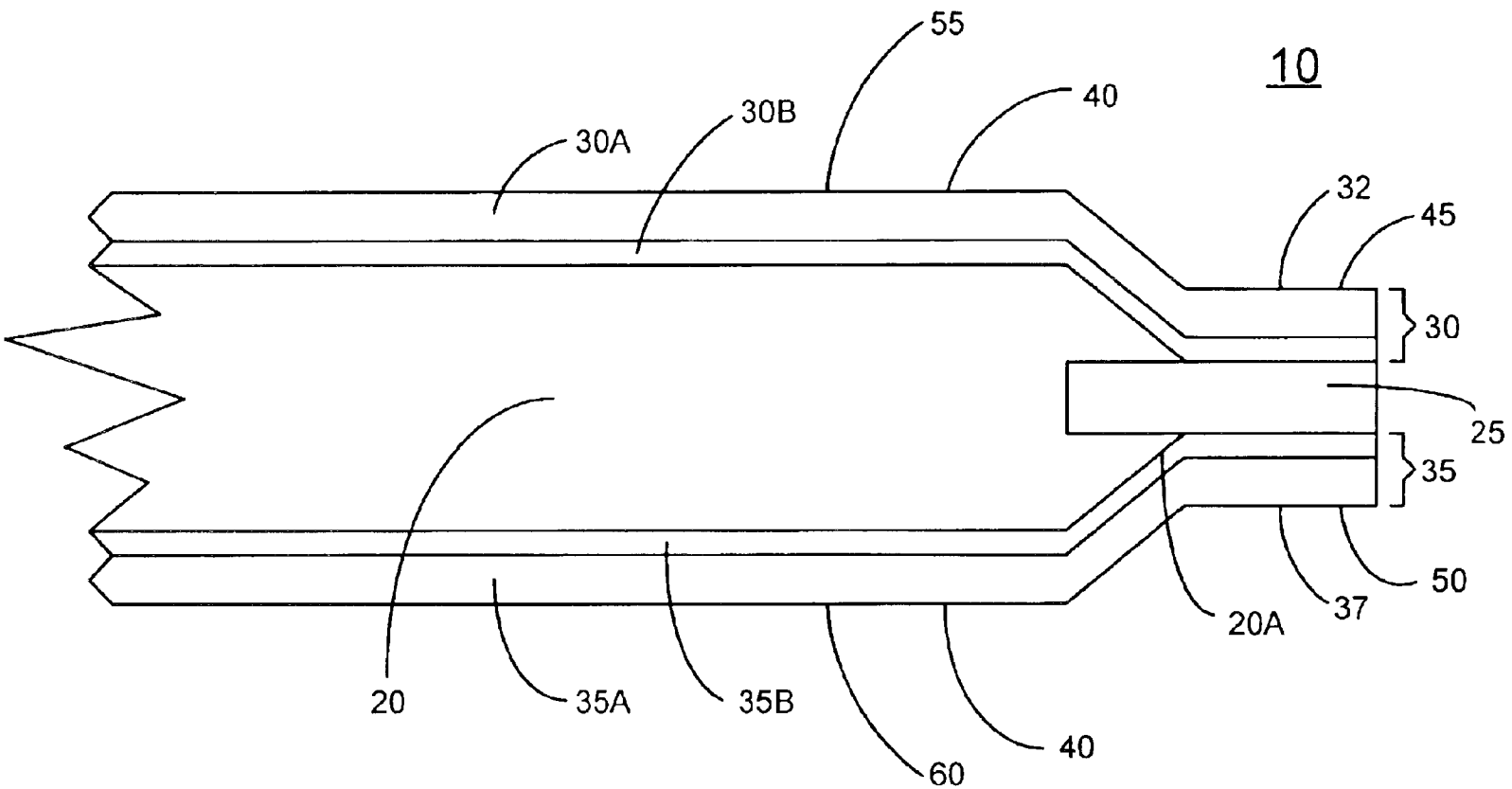
FIG. 2 is a cross sectional view of the anti-fatigue mat of FIG. 1 taken along section line 2—2.

To more clearly show the inner details of mat 10, FIG. 2 provides a cross section of the mat taken along section line 2—2 of FIG. 1. As seen in FIG. 2, mat 10 includes an inner layer 20 fabricated of resilient material, for example a viscoelastic polymer material such as a polyurethane-based gel or a silicon-based gel. A support ring 25 made of a stiff material is located adjacent peripheral edge 20A of resilient inner layer 20 as shown. Support ring 25 extends around the perimeter of mat 10 and stiffens the mat at its periphery as will be discussed in more detail later.

A cover member 30 is situated atop resilient inner layer 20 and a cover member 35 is situated below resilient inner layer 20 as shown. Cover members 30, 35 together with support ring 25 form the cover assembly 40 of mat 10. In this particular embodiment, cover members 30 and 35 each include 2 layers, namely an outer layer and an inner layer. More particularly, cover member 30 includes an outer layer 30A and an inner layer 30B. Likewise, cover member 35 includes an outer layer 35A and an inner layer 35B. Outer layers 30A and 35A are fabricated of a durable, flexible material such as vinyl or urethane. Outer layers 30A and 35A determine the outward cosmetic appearance of mat 10 in this particular embodiment. Inner layers 30B and 35B are fabricated of a flexible woven material such as polyester or cotton. The material selected for inner layers 30B and 35B includes spaces through which outer layers 30A and 35A flow when outer layers 30A and 35A are melted in a support ring 25 bonding process later described. In one embodiment, layers 30A and 30B are bonded to each other by adhesive such as methylene chloride or VHB therebetween to form cover member 30. (VHB is a trademark of 3M Corporation.) Similarly, layers 35A and 35B are adhesively held together to form cover member 35. Layers 30A and 30B can also be bonded together using radio frequency (RF) welding or ultrasonic bonding. Layers 35A and 35B can be likewise bonded.

Support ring 25, which extends around the perimeter of mat 10, provides an intermediate structure between cover member 30 and cover member 35 to which both cover members 30 and 35 are bonded, sealed or otherwise attached. Support ring 25 is situated between perimeter regions 32 and 37 which surround cover members 30 and 35, respectively. In one embodiment, support ring 25 exhibits a stiffness greater than the stiffness of covers 30 and 35. Support ring 25 is an intermediate structural member to which both cover members 30 and 35 are heat bonded or heat sealed together. In this manner, resilient inner layer 20 is held in position within mat 10. In one embodiment, support ring 25 is fabricated of vinyl. To seal the peripheral edges of covers 30 and 35 to support ring 25 therebetween, heat sealing or heat bonding is employed. In more, detail, the components of mat 10 are assembled in the positions indicated in FIG. 2. Then flange 45 and flange 50, adjacent perimeter regions 32 and 37 of cover members 30 and 35, respectively, are squeezed together by a press exerting a pressure within the range of approximately 90 psi to approximately 100 psi while concurrently being heated to a temperature within the range of approximately 280 degrees F, to approximately 320 degrees F. The temperature and pressure may vary outside the prescribed ranges above depending on the particular materials selected for cover members 30 and 35 and support ring 25. The temperature should be sufficiently high that outer layer 30A and outer layer 35A will melt and flow through the woven inner layer 30B and 35B, respectively, to bond to support ring 25. Bonds are thus formed between cover members 30, 35 and support ring 25 to enhance the structural integrity of the resultant mat along its perimeter. Support ring 25 exhibits a geometry like that of the perimeter of mat 10. For example, if the geometry of mat 10 is rectangular, square, circular or elliptical, then the geometry of support ring 25 is likewise rectangular, square, circular or elliptical, respectively. It has found that by providing a support ring 25 as an intermediate stiffener structure between cover members 30, 35 the durability of mat 10 is enhanced. Support ring 25 has multiple advantages. It was found that if cover 30 is bonded directly to cover 35, an unevenness or waviness in the resultant structure can occur in the areas so bonded. Providing mat 10 with support ring 25 results in a smooth and even surface in the areas bonded. In one embodiment the color of cover 30 is different than the color of cover 35. In that embodiment it has been found that support ring 25 advantageously prevents color migration between cover 30 and cover 35. Moreover, support ring 25 improves adhesion between cover 30 and cover 35. It is also noted that support ring provides more structural integrity to mat 10 than if cover 30 were directly bonded to cover 35, although such an embodiment is contemplated as well. In such an alternative embodiment, flange 45 of cover member 30 is directly heat sealed, heat bonded or otherwise attached to flange 50 of cover member 35.

Cover member 30 includes an outer cover surface 55 while cover member 35 includes an outer cover surface 60. Outer surfaces 55 and 60 have the following characteristics in representative embodiments. One or both of external surfaces 55 and 60 can exhibit an anti-skid or anti-slide surface such as soft vinyl. One anti-slip surface is a textured or variegated surface which exhibits more friction than a smooth external surface. Outer surfaces 55 and 60 can exhibit the same color. Alternatively, outer surfaces 55 and 60 can exhibit different colors to provide an integral multicolor option feature.

Figure 3:
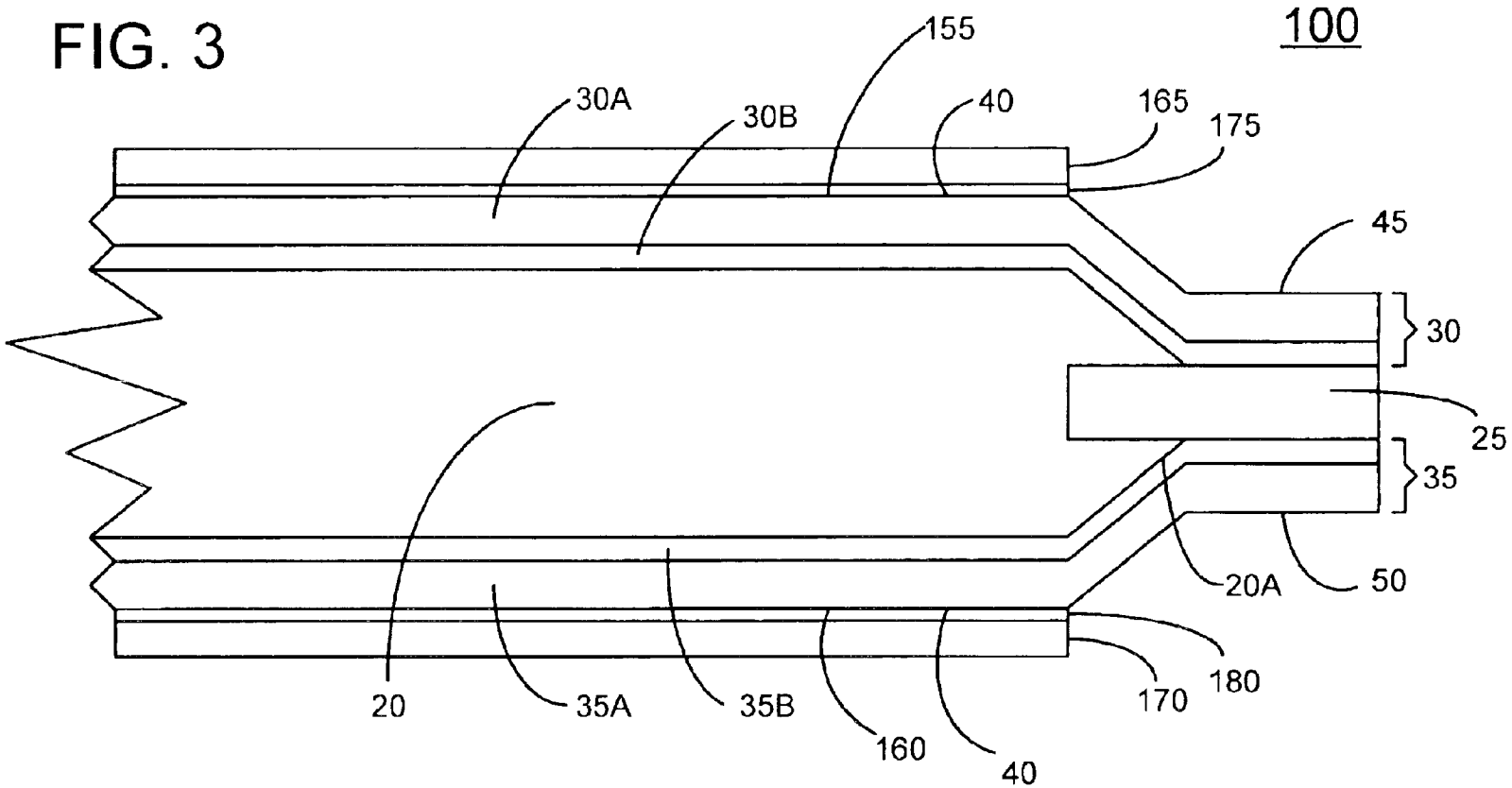
FIG. 3 is an alternative embodiment of the mat of FIG. 2.

While mat 10 of FIG. 2 includes outer surfaces 55 and 60 which themselves exhibit the color or texture properties described above, FIG. 3 shows an alternative embodiment, namely mat 100, in which outer cover surfaces 155 and 160 are adhesively permanently connected to, or removably connected to, outermost layers 165 and 170. In this embodiment, one or both of outermost layers 165 and 170 can exhibit an anti-skid surface such as discussed above. One or both of outermost layers 165 and 170 can exhibit the same color or different colors to provide an integral multicolor option feature. Outermost layers 165 and 170 are connected to outer surfaces 155 and 160 respectively, by respective connective layers 175 and 180, therebetween. In one embodiment, connective layers 175 and 180 are an adhesive such as double-sided tape with VHB adhesive so that outermost layers 165 and 170 are permanently connected to outer surfaces 155 and 160, respectively. In another embodiment, connective layers 175 and 180 are hook and loop fasteners such that outermost layers 165 and 170 are removably connected to outer surfaces 155 and 160, respectively. In the latter embodiment, the user can readily select the desired color and anti-skid properties for outermost layers 165 and 170 of mat 100. If the mat is provided with outermost layer 165 exhibiting one color and outermost layer 170 exhibiting another color, then mat 100 is reversible in two senses, namely 1) you can turn the mat over to change colors, and 2) you can remove outermost layer 165 or outermost layer 170 and exchange it with another outermost layer exhibiting a different color or texture.

Figure 4:
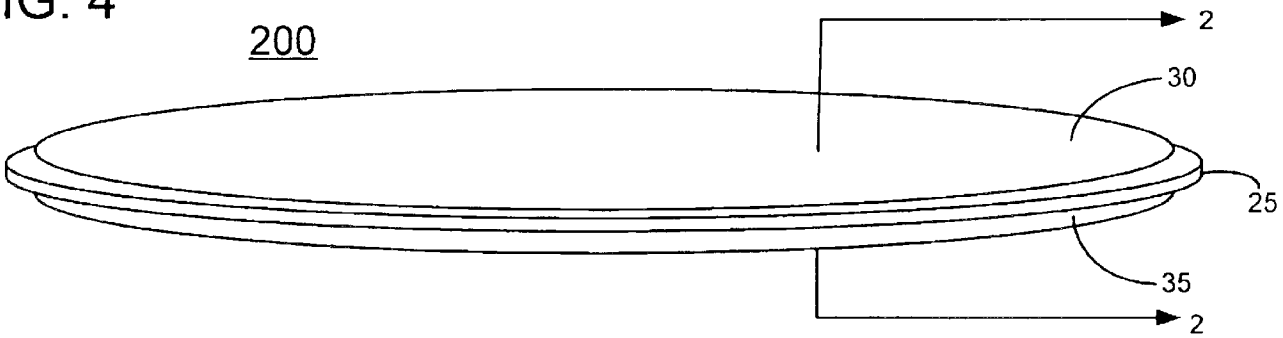
FIG. 4 is another alternative embodiment of the mat of FIG. 2.

FIG. 4 depicts an alternative embodiment of the mat as mat 200 wherein the mat is circular or elliptical. Mat 200 has the same cross section as that depicted in FIG. 2.

Figure 5:
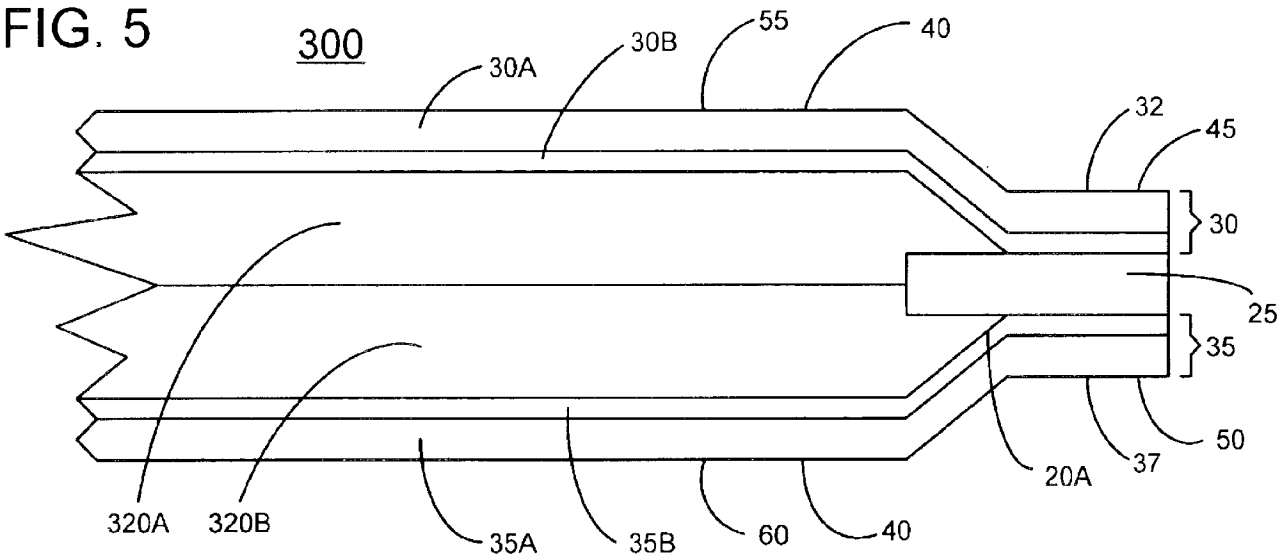
FIG. 5 is yet another alternative embodiment of the disclosed mat technology.

FIG. 5 shows another alternative embodiment of the disclosed mat wherein the resilient inner layer is formed into two layers, namely a resilient upper layer 320A exhibiting a first density and a resilient lower layer 320B exhibiting a second density. Similar numbers are used to indicate like structures when comparing mat 300 of FIG. 5 with mat 10 of FIG. 2. Resilient layers 320A and 320B are formed from the same material employed for inner layer 20 of mat 10 in FIG. 2. The density of resilient upper layer 320A is selected to be less than the density of resilient lower layer 320B. Fabricating the inner resilient layer in this manner from two resilient layers 320A and 320B of different densities or resilience has the advantage of providing a mat which imparts a very soft feeling for a user standing on or otherwise contacting cover 30 which is atop resilient upper layer 320A. Advantageously, providing mat 10 with a higher density resilient lower layer 320B prevents the mat from "bottoming out" when a user stands on or otherwise contacts the mat.

When a user stands on mat 10, the user is provided with a comfortable feeling. Mat 10 is found to be especially comfortable when stood on for long periods of time. People experiencing pain when standing for long periods of time have been found to experience less pain when using the disclosed mat.

Although illustrative embodiments have been shown and described, a wide range of modification, change and substitution is contemplated in the foregoing disclosure and in some instances, some features of an embodiment may be employed without a corresponding use of other features. Accordingly, it is appropriate that the appended claims be construed broadly and in manner consistent with the scope of the embodiments disclosed herein.

What is claimed is:

1. An anti-fatigue mat comprising:

a resilient gel layer exhibiting first and second major opposed surfaces and a peripheral edge;

a first flexible cover member situated on the first major opposed surface of the resilient gel layer; and a second flexible cover member situated on the second major opposed surface of the resilient gel layer, the second flexible cover member being attached to the first flexible cover member adjacent the peripheral edge, the second flexible cover member including an external surface which exhibits anti-slip properties; and a support ring situated between the first and second flexible cover members adjacent the peripheral edge of the resilient gel layer.

2. The anti-fatigue mat of claim 1 wherein the support ring exhibits a stiffness greater than the stiffness of the first and second flexible cover members.

3. The anti-fatigue mat of claim 1 wherein the mat exhibits a rectangular geometry.

4. The anti-fatigue mat of claim 1 wherein the mat exhibits a square geometry.

5. The anti-fatigue mat of claim 1 wherein the mat exhibits a circular geometry.

6. The anti-fatigue mat of claim 1 wherein the mat exhibits an elliptical geometry.

7. An anti-fatigue mat comprising:

a resilient gel layer exhibiting first and second major opposed surfaces and a peripheral edge;

a first flexible cover member situated on the first major opposed surface of the resilient gel layer, the first flexible cover member including a first perimeter region;

a second flexible cover member situated on the second major opposed surface of the resilient gel layer; the second flexible cover member including a second perimeter region; and a support ring situated between the first and second perimeter regions adjacent the peripheral edge of the resilient gel layer.

8. The anti-fatigue mat of claim 7 wherein the first flexible cover member includes an outer cover surface exhibiting a first color.

9. The anti-fatigue mat of claim 7 wherein the second flexible cover member includes an outer cover surface exhibiting a second color.

10. The anti-fatigue mat of claim 7 wherein the first flexible cover member includes an outer cover surface exhibiting anti-slip properties.

11. The anti-fatigue mat of claim 7 wherein the second flexible cover member includes an outer cover surface exhibiting anti-slip properties.

12. The anti-fatigue mat of claim 7 wherein the support ring exhibits a stiffness greater than the stiffness of the first and second flexible cover members.

13. The anti-fatigue mat of claim 7 wherein the mat exhibits a rectangular geometry.

14. The anti-fatigue mat of claim 7 wherein the mat exhibits a square geometry.

15. The anti-fatigue mat of claim 7 wherein the mat exhibits a circular geometry.

16. The anti-fatigue mat of claim 7 wherein the mat exhibits an elliptical geometry.

17. The anti-fatigue mat of claim 7 wherein a first outermost layer is attached to the first flexible cover member.

18. The anti-fatigue mat of claim 17 wherein a second outermost layer is attached to the second flexible cover member.

19. The anti-fatigue mat of claim 18 wherein the first outermost layer is attached to the first flexible cover member by a first layer of adhesive therebetween.

20. The anti-fatigue mat of claim 19 wherein the second outermost layer is attached to the second flexible cover member by second layer of adhesive therebetween.

21. The anti-fatigue mat of claim 18 wherein the second outermost layer is attached to the second flexible cover member by hook and loop fasteners therebetween.

22. The anti-fatigue mat of claim 17 wherein the first outermost member exhibits a first color.

23. The anti-fatigue mat of claim 22 wherein the second outermost member exhibits a second color.

24. The anti-fatigue mat of claim 17 wherein the first outermost layer is attached to the first flexible cover member by hook and loop fasteners therebetween.

25. The anti-fatigue mat of claim 7 wherein the resilient gel layer includes a first resilient layer exhibiting a first density and a second resilient layer exhibiting a second density.

* * * * *